United States Patent [19]

Nauheimer et al.

[11] 4,294,358

[45] Oct. 13, 1981

[54] PACKAGE FOR VIDEO TUBES

[75] Inventors: James F. Nauheimer, Chicago; Steven J. Benzschawel, Carol Stream, both of Ill.

[73] Assignee: Container Corporation of America, Chicago, Ill.

[21] Appl. No.: 140,301

[22] Filed: Apr. 14, 1980

[51] Int. Cl.[3] ..... B65D 85/42

[52] U.S. Cl. ..... 206/419; 220/410; 229/15

[58] Field of Search ..... 206/419, 420, 421, 422, 206/563, 562; 220/410; 229/15

[56] References Cited

U.S. PATENT DOCUMENTS 2,623,682 12/1952 Candell ..... 206/419

4,088,225 5/1978 Hartnell ..... 206/419

FOREIGN PATENT DOCUMENTS 2400995 7/1975 Fed. Rep. of Germany ..... 206/419

*Primary Examiner*—Joseph Man-Fu Moy

*Attorney, Agent, or Firm*—R. W. Carpenter; Davis Chin

[57] ABSTRACT

A package for a plurality of articles such as video tubes is disclosed. The viewing screens of the video tubes are protected from contact with the walls of a walled tube enclosing the video tubes and forming part of the package. Video tube envelopes are cradled in a platform supported within the walled tube and having cutouts therein locating the tube envelope and supporting the same.

3 Claims, 4 Drawing Figures

PACKAGE FOR VIDEO TUBES

SUMMARY OF THE INVENTION

The structure according to the invention enables a plurality of video tapes (preferably four in number) to be supported on a platform received within a walled tube, the latter nesting along the bottom within a tray with the top of the walled tube received within an inverted tray.

THE DRAWINGS

SPECIFICATION

Figure 2:
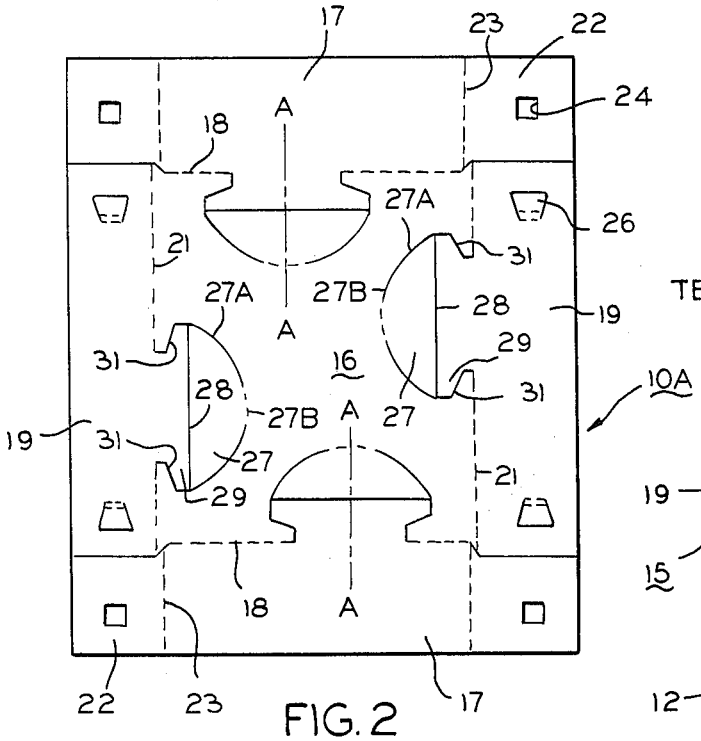
FIG. 2 is a plan view of a cut and scored blank for forming a platform within the package of FIG. 1 for support of a plurality of video tubes.
Figure 1:
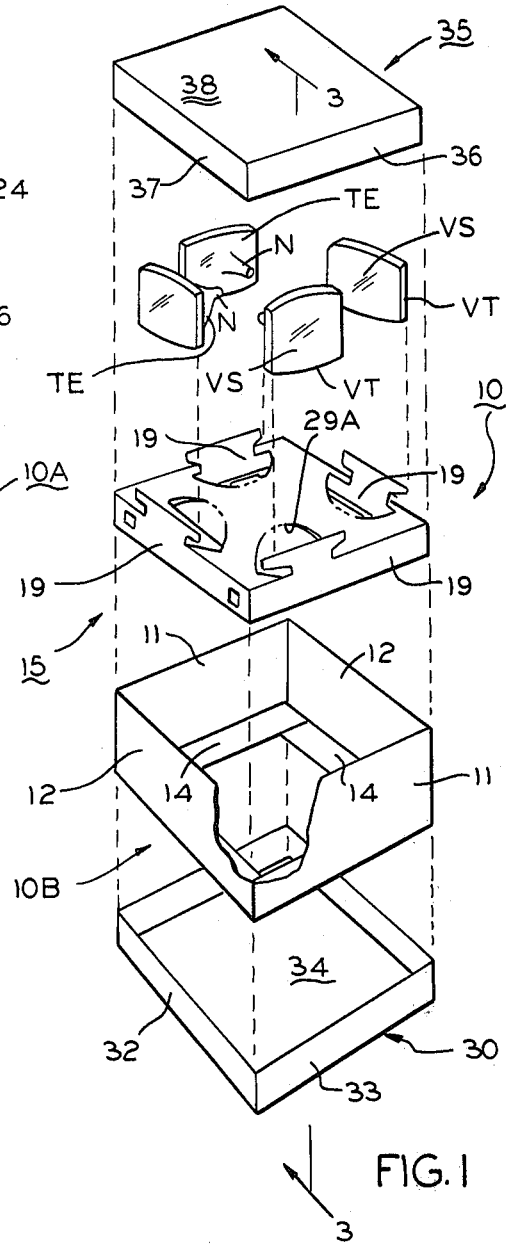
FIG. 1 is an exploded isometric view of a package embodying the improvements according to the invention.

The package according to the present invention is denoted by the reference number 10 and includes a platform 15 for supporting a plurality of video tubes VT, each having a viewing screen VS, a tube envelope TE and a neck N.

The platform 15 is formed from a blank 10A which when folded and erected, is placed within a walled tube 10B of rectangular cross-section. The walled tube 10B has opposed end walls 11 and opposed side walls 12. Flanges 12 are inturned from the bottoms of the walls 11 and 12 to locate the platform 15 in position within the tube 10B.

A platform 15 has a platform panel 16 of dimensions corresponding to the cross-section of the walled tube 10B, so that when the platform 15 is erected, it is received with a tight siding fit within the tube 10B.

A structure is provided for maintaining the panel 16 in spaced relationship with respect to the inturned flanges of the walled tube 10B, and to this end, the panel 16 has opposed end flaps 17 foldable with respect thereto along fold lines 18, and opposed side flaps 19 foldable with respect thereto along fold lines 21.

The ends of the flaps 17 have locking flaps 22 foldable with respect thereto along fold lines 23. Apertures 24 in the locking flaps 22 cooperate with locking tabs 26 in the side flaps 19, so that when the flaps 17 and 19 are erected by folding the same about the fold lines 18 and 21 they can be maintained in locked relationship.

The platform panel 16 is provided with a plurality of cutout panels 27 essentially in the form of sectors of a circle and defined by arcuate cut lines 27A and a chordal cut line 27 intersecting the cut lines 27A. The cut lines 27A are discontinuous at a short fold line 27B therebetween, and the cutout panel 27 is foldable out of the plane of the panel 16, as seen in FIGS. 3 and 4.

The fold lines 18 and 21 are discontinuous to provide flaps 29 which are upstanding upon erection of the side and end flaps 19 and 17, the flaps 29 beng defined by cut lines 31 in the platform panel 16 and forming continuations of the arcuate cut lines 27A. The flaps 29 lie against viewing screens VS, as best seen in FIG. 3.

Figure 3:
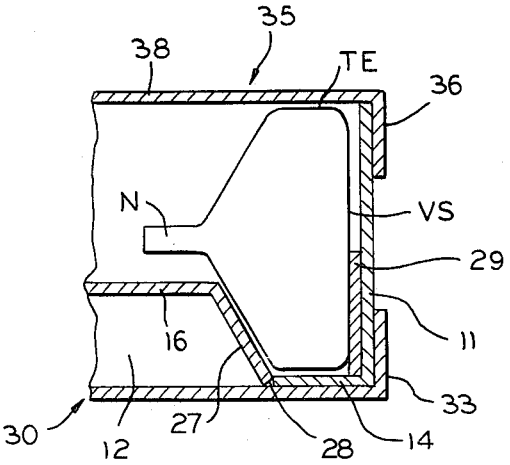
FIG. 3 is a vertical sectional view to an enlarged scale taken through the assembled package of FIG. 1 showing a video tube supported on the platform.
Figure 4:
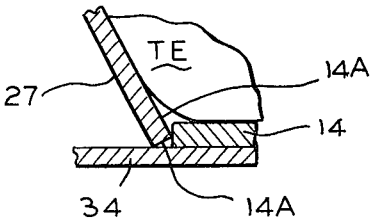
FIG. 4 is an enlarged scale view of a portion of FIG. 3.

Upon folding of the cutout panel 27 to the position seen in FIGS. 3 and 4, and the erecting of the flaps 17 and 19, the platform panel 16 is provided with openings 29A cradling the tube envelopes TE of the video tubes VT.

The sector-shaped cutout panels 27 are each formed along an axis A—A lying parallel to the axis of an opposed panel 27, and each pair of parallel axes A—A intersects the other pair. The video tube necks N lie along these axes but the dimensions of same are such that there is no contact between the necks.

When the platform 15 is placed into the walled tube 10B, the distal edge of each cutout flap 27 is braced against the edge 14A of an inturned flange 14, as seen in FIGS. 3 and 4, effectively bracing the platform 15 and forming a support for the tube envelope TE.

With the platform 15 loaded with the tubes VT and placed within the walled tube 10B, such assembly is placed upon a tray 30 having opposed tray side and end walls 32 and 33 upstanding from a base panel 34, the tray side and end walls 32 and 33 closely embracing the sides and ends of the tube 10B.

The package 10 is completed by placing an inverted tray 35 over the walled tube 10B, tray 35 having opposed end walls 36 and opposed side walls 37 extending from a cover panel 38 and embracing the walls of the tube 10B.

I claim:

1. In a package for a plurality of necked articles of commerce, such as video tube envelopes having a viewing screen at one end and a neck at the other end:

(a) a walled tube of rectangular cross-section having inturned flanges along the bottoms of the walls of said tube;

(b) a platform of rectangular cross-section nesting within said walled tube and including a platform panel having flaps extending downward against said flanges to maintain said platform in spaced relationship to said flanges;

(c) protective and support means formed in said platform panel for said tube envelopes comprising at least one cutout panel in said platform panel, one portion of which is foldable with respect to said platform panel and downward against an inturned flange to brace against said inturned flange and form a support for a tube envelope.

2. A package according to claim 1, wherein a flap portion is joined to a flap of said platform panel and folded upward with said flap to protect the viewing screen of said tube envelope.

3. A package according to claim 1, wherein said walled tube rests upon a tray, the upper part of said tube being covered by an inverted tray.

* * * * *